US008711076B2

(12) United States Patent
Shin et al.

(10) Patent No.: US 8,711,076 B2
(45) Date of Patent: Apr. 29, 2014

(54) TIMING CONTROLLER CAPABLE OF REMOVING SURGE SIGNAL AND DISPLAY APPARATUS INCLUDING THE SAME

(75) Inventors: Ock Chul Shin, Seoul (KR); Yeong Cheol Rhee, Suwon-si (KR); Byung Koan Kim, Suwon-si (KR)

(73) Assignee: Samsung Electronics Co., Ltd., Suwon-Si, Gyeonggi-Do (KR)

( * ) Notice: Subject to any disclaimer, the term of this patent is extended or adjusted under 35 U.S.C. 154(b) by 1179 days.

(21) Appl. No.: 12/574,198

(22) Filed: Oct. 6, 2009

(65) Prior Publication Data

US 2010/0085368 A1 Apr. 8, 2010

(30) Foreign Application Priority Data

Oct. 7, 2008 (KR) ..... 10-2008-0098309

(51) Int. Cl.
*G09G 3/36* (2006.01)

(52) U.S. Cl.
USPC ..... 345/99

(58) Field of Classification Search
USPC ..... 345/99
See application file for complete search history.

(56) References Cited

U.S. PATENT DOCUMENTS

| | | | | |
|---|---|---|---|---|
| 4,929,870 | A * | 5/1990 | Harju | 315/169.3 |
| 5,684,830 | A * | 11/1997 | Ichikawa et al. | 375/254 |
| 6,801,583 | B1 * | 10/2004 | Claxton et al. | 375/316 |
| 2002/0095626 | A1 * | 7/2002 | Helmsen et al. | 714/48 |
| 2007/0164969 | A1 | 7/2007 | Kim | |

FOREIGN PATENT DOCUMENTS

| | | |
|---|---|---|
| KR | 1020060077207 | 7/2006 |
| KR | 1020070071955 | 7/2007 |
| KR | 1020070080491 | 8/2007 |

* cited by examiner

*Primary Examiner* — William Boddie
*Assistant Examiner* — Andrew Schnirel
(74) *Attorney, Agent, or Firm* — F. Chau & Associates, LLC

(57) ABSTRACT

A timing controller includes a first stage removing a first surge signal generated during a first logic level period of a data enable signal, and a second stage receiving the data enable signal generated by the first stage and removing a second surge signal generated during a second logic level period of the received data enable signal.

19 Claims, 14 Drawing Sheets

FIG. 10

| SSCG_EN | MEM_ON | read clock | BUFFERING | REMARK |
|---|---|---|---|---|
| 0 | 0 | CLK | 0 | DATA bypass |
| 0 | 1 | CLK | 1 | Buffered DATA |
| 1 | 0 | SSCG_CK | 1 | Buffered DATA |
| 1 | 1 | SSCG_CK | 1 | Buffered DATA |

TIMING CONTROLLER CAPABLE OF REMOVING SURGE SIGNAL AND DISPLAY APPARATUS INCLUDING THE SAME

CROSS-REFERENCE TO RELATED APPLICATIONS

This application claims priority to Korean Patent Application No. 10-2008-0098309, filed on Oct. 7, 2008, in the Korean Intellectual Property Office, the disclosure of which is incorporated by reference in its entirety herein.

BACKGROUND

1. Technical Field

Embodiments of the inventive concept relate to a timing controller capable of removing a surge signal and a display apparatus including the same.

2. Discussion of Related Art

The display resolution of a display apparatus typically refers to the number of distinct pixels in each dimension that can be displayed. As the size of the display apparatus increases, the resolution may increase accordingly. To display a high quality image, the resolution may be increased by increasing the integrity of pixels in the display apparatus.

The display apparatus may include a timing controller that outputs a data enable signal indicating the effective period of input video data. During the effective period, the input video is valid and can be displayed. However, the data enable signal may be distorted by a surge signal, thereby resulting in a reduction in the display quality.

Thus, there is a need for a timing controller that is capable of removing the surge signal from the data enable signal and a display apparatus including the same.

SUMMARY

A timing controller according to an exemplary embodiment of the inventive concept includes a first stage removing a first surge signal generated during a first logic level period of a data enable signal, and a second stage receiving the data enable signal generated by the first stage and remove a second surge signal generated during a second logic level period of a received data enable signal.

The first stage may include a counter counting the number of cycles of a first clock signal that oscillates during the second logic level period of the first surge signal and outputting a count result, a comparator comparing an output result of the counter and a reference value and outputting a comparison result, and a data enable signal correction unit outputting the data enable signal without change, or removing the first surge signal generated in the second logic level during the first logic level period of the data enable signal and outputting a signal removed of the first surge signal as the data enable signal, based on the comparison result of the comparator.

The first stage may include a delay receiving the data enable signal, delaying a received data enable signal for a predetermined period of time, and outputting a delayed data enable signal; a logic operation unit performing a logic operation on the data enable signal and the delayed data enable signal and outputting a logic operation result; and a selector, in response to a control signal, outputting the data enable signal or the logic operation result as a data enable signal removed of the first surge signal.

The second stage may include a first selector, in response to a first control signal, outputting any one of the first clock signal and a second clock signal, a logic operation unit performing a logic operation on the first control signal and a second control signal and outputting a logic operation result, and a read/write controller storing image data based on the first clock signal and reading the image data based on an output signal of the selector.

A display apparatus according to an exemplary embodiment of the inventive concept includes a timing controller configured to receive odd image data, even image data, odd data enable signal, and even data enable signal, output image data from the odd and even image data, output a corrected data enable signal from the odd and even data enable signals, and a gate control signal, a display panel including data and gate lines, a source driver configured to receive the image data and the corrected data enable signal from the timing controller and drive the data lines of the display panel, and a gate driver configured to receive the gate control signal from the timing controller and drive the gate lines of the display panel. The timing controller includes a low voltage differential signaling (LVDS) signal receiving unit configured to output odd image data, even image data, an odd data enable signal indicating an effective period of the odd image data, an even data enable signal indicating an effective period of the even image data, and a clock signal, a first stage configured to latch the odd image data, even image data, odd data enable signal, and even data enable signal in response to the clock signal, perform a logical operation on the latched odd and even data enable signals to generate a first data enable signal, and output the image data from the odd and even image data, a second stage configured to receive the first data enable signal and the image data from the first stage and remove a first surge signal generated during a first logic level period of the first data enable signal to generate a second data enable signal, and a third stage configured to receive the second data enable signal and the image data from the second stage and remove a second surge signal generated during a second and different logic level period of the received data enable signal to generate the corrected data enable signal.

A timing controller for driving a source driver and a gate driver of display apparatus according to an exemplary embodiment of the inventive concept includes a timing controller configured to receive odd image data, even image data, an odd data enable signal, and an even data enable signal, output image data from the odd and even image data, and output a corrected data enable signal. The timing controller includes a first stage configured to latch the odd image data, even image data, odd data enable signal, and even data enable signal in response to a clock signal, perform a logical operation on the latched odd and even data enable signals to generate a first data enable signal, and output the image data from the odd and even image data, a second stage configured to receive the first data enable signal and the image data from the first stage and remove a first surge signal generated during a first logic level period of the first data enable signal to generate a second data enable signal, and a third stage configured to receive the second data enable signal and the image data from the second stage and remove a second surge signal generated during a second logic level period of the received data enable signal to generate the corrected data enable signal.

BRIEF DESCRIPTION OF THE DRAWINGS

Exemplary embodiments of the inventive concept will be more clearly understood from the following detailed description taken in conjunction with the accompanying drawings in which:

FIG. 10 is a table for explaining an operation of the read/write controller of FIG. 7;

DETAILED DESCRIPTION OF THE EMBODIMENTS

Figure 1:
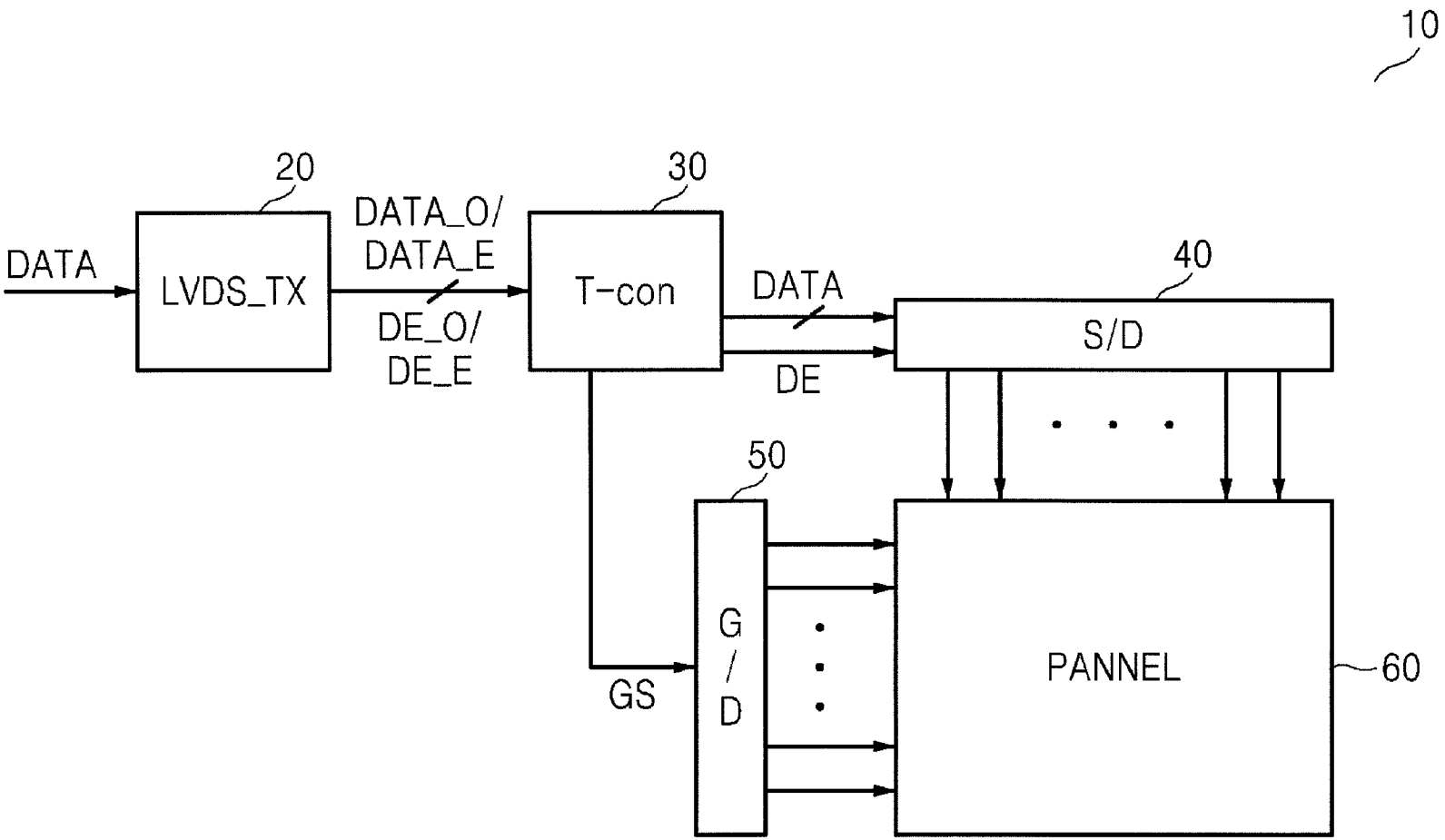
FIG. 1 is a block diagram of a display apparatus according to an exemplary embodiment of the inventive concept.

Hereinafter, the inventive concept will be described in detail by explaining embodiments of the inventive concept with reference to the attached drawings. Like reference numerals in the drawings denote like elements.

It will be understood that when an element is referred to as being "connected" or "coupled" to another element, it can be directly connected or coupled to the other element or intervening elements may be present.

Figure 2:
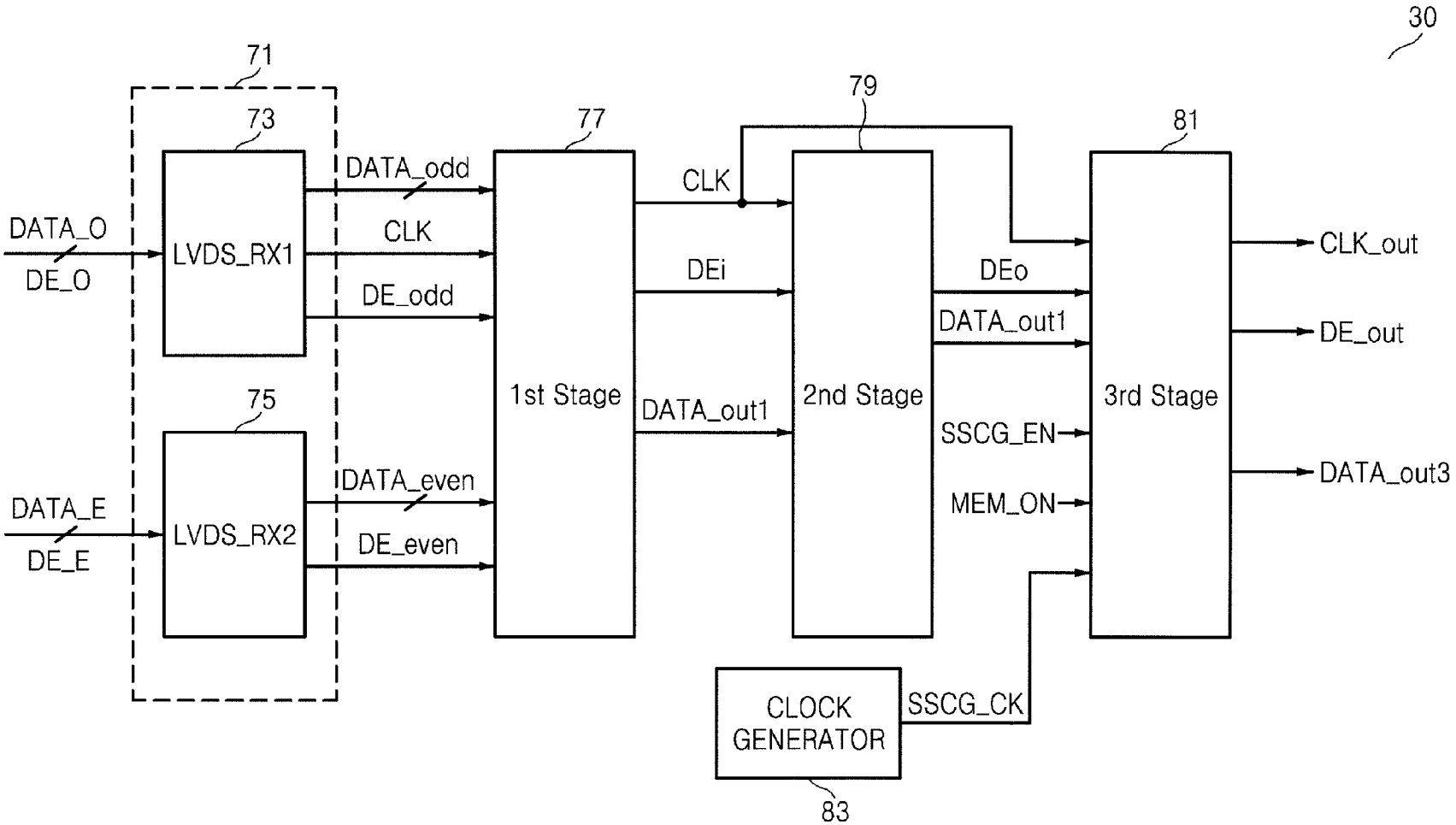
FIG. 2 is a block diagram of a timing controller according to an exemplary embodiment of the inventive concept.

FIG. 1 is a block diagram of a display apparatus 10 according to an exemplary embodiment of the inventive concept. FIG. 2 is a block diagram of a timing controller 30 according to an exemplary embodiment of the inventive concept. Referring to FIGS. 1 and 2, the display apparatus 10 that may be a flat display apparatus such as a TFT-LCD, a PDP or an OLED includes a low voltage differential signaling (LVDS) signal transmission unit 20, the timing controller 30, a source driver or a data line driver 40, a gate driver or a scan line driver 50, and a display panel 60.

The LVDS signal transmission unit 20, according to an LVDS interface method, may receive image data or pixel data DATA, and output a first image data DATA_O and a first data enable signal DE_O corresponding to the odd data of pixel data of an N-th horizontal line (e.g., where N is natural number) among the received image data DATA. The LVDS signal transmission unit 20 may also output a second image data DATA_E and a second data enable signal DE_E corresponding to the even data of the image data of the N-th horizontal line. The first data enable signal DE_O may be a signal indicating an effective period of the first image data DATA_O. The second data enable signal DE_E may be a signal indicating an effective period of the second image data DATA_E. Data of the image data DATA_O and DATA_E may be valid during the effective period and invalid outside the effective period.

The timing controller 30 may output the image data DATA of the N-th horizontal line to the source driver 40 based on the data enable signals DE_E and DE_O and image data DATA_O and DATA_E output from the LVDS signal transmission unit 20. The timing controller 30 may output an data enable signal DE indicating the effective period of the image data DATA to the source driver 40 based on the first data enable signal DE_O and the second data enable signal DE_E.

Figure 3:
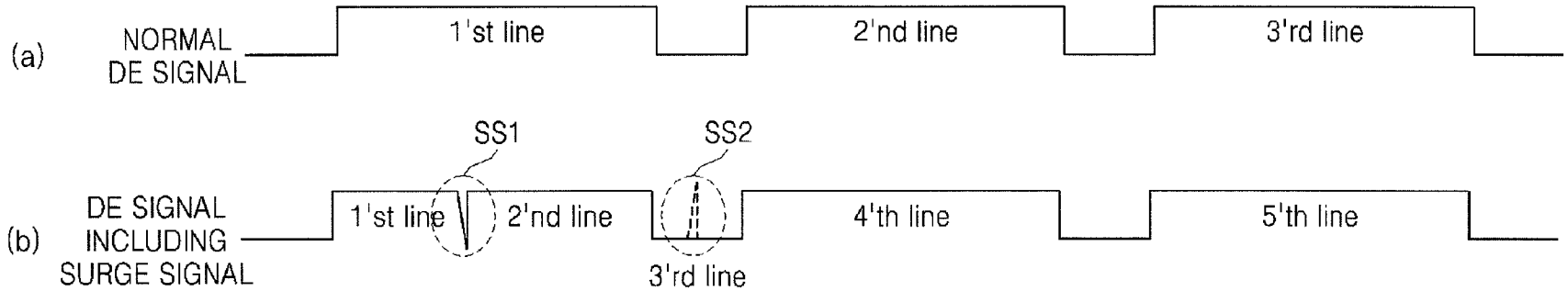
FIG. 3 illustrates the effect of a surge signal that may be generated in the display apparatus of FIG. 1.

The timing controller 30 may remove a surge signal, for example, SS1 and SS2 of FIG. 3, that may be included in the first data enable signal DE_O and the second data enable signal DE_E. The timing controller 30 can then output the data enable signal DE excluding the surge signals SS1 and SS2 to the source driver 40. The surge signal may be generated due to electrostatic discharge (ESD) or electromagnetic interference (EMI) and may distort the data enable signal DE.

FIG. 3 illustrates the effect of a surge signal that may be generated in the display apparatus of FIG. 1. Referring to FIG. 3, graph (a) indicates a normal data enable signal, for example, the first data enable signal DE_O or the second data enable signal DE_E, and graph (b) indicates a data enable signal including the surge signals SS1 and SS2.

For example, when the surge signals SS1 and SS2 are included in the data enable signal, the normal data enable signal may be distorted so that incorrect video data may be displayed on the display panel 60 of FIG. 1. When the timing controller 30 recognizes the image data DATA of the N-th horizontal line in response to a first edge, for example, a rising edge, of the data enable signal DE, the timing controller 30 may erroneously recognize a section of the N-th horizontal line due to the surge signals SS1 and SS2.

The timing controller 30 may output a driving signal or a control signal, for example, a horizontal sync signal or a vertical sync signal, to drive the source driver 40 and a gate driver driving signal or a control signal GS to drive the gate driver 50. Referring back to FIGS. 1 and 2, the timing controller 30 may include an LVDS signal receiving unit 71, a first stage 77, a second stage 79, and a third stage 81.

The LVDS signal receiving unit 71 may interface between the LVSD signal transmission unit 20 and the first stage 77 to enable communication of signals there between. For example, the signals may include the first data enable signal DE_O and the second data enable signal DE_E, and image data, for example, the first image data DATA_O and the second image data DATA_E, which are output from the LVDS signal transmission unit 20.

The LVDS signal receiving unit 71, according to an LVDS interface method, may convert the first image data DATA_O, the first data enable signal DE_O, the second image data DATA_E, and the second data enable signal DE_E, which are received from the LVDS signal transmission unit 20, to a predetermined signal level, and output corresponding level converted signals (e.g., a third image data DATA_odd, a third data enable signal DE_odd, a fourth image data DATA_even, and a fourth data enable signal DE_even).

The LVDS signal receiving unit 71 may alternately output the data enable signals and image data without a level change (e.g., the first data enable signal DE_O, the second data enable signal DE_E, the first image data DATA_O, and the second image data DATA_E, which are output from the LVDS signal transmission unit 20).

When the signals are output without a level change, the first data enable signal DE_O and the third data enable signal DE_odd may be the same or substantially the same, the second data enable signal DE_E and the fourth data enable signal DE_even may be the same or substantially the same, the first image data DATA_O and the third image data DATA_odd may be the same or substantially the same, and the second image data DATA_E and the fourth image data DATA_even may be the same or substantially the same. The LVDS signal receiving unit 71 may also generate a first clock signal CLK having a first frequency and transmit a generated first clock signal CLK to the first stage 77.

The LVDS signal receiving unit 71 may include a first LVDS signal receiving unit 73 (e.g., LVDS_RX1) and a second LVDS signal receiving unit 75 (e.g., LVDS_RX2). The first LVDS signal receiving unit 73 may receive the first image data DATA_O and the first data enable signal DE_O and interface with the first stage 77. For example, the first LVDS signal receiving unit 73 may convert each of the first image data DATA_O and the first data enable signal DE_O to a predetermined signal level, and output corresponding level converted signals, for example, the third image data DATA_odd and the third data enable signal DE_odd. The first LVDS signal receiving unit 73 may also generate a first clock signal CLK and transmit the first clock signal CLK to the first stage 77.

The second LVDS signal receiving unit 75 may receive the second image data DATA_E and the second data enable signal DE_E and interface with the first stage 77. For example, the second LVDS signal receiving unit 75 may convert each of the second image data DATA_E and the second data enable signal DE_E to a predetermined signal level, and output corresponding level converted signals, for example, the fourth image data DATA_even and the fourth data enable signal DE_even. Although FIG. 2 shows the first clock signal CLK is generated by the first LVDS signal receiving unit 73, in an alternate embodiment, the first clock signal CLK transmitted to the first stage 77 may be generated by the second LVDS signal receiving unit 75.

Figure 4:
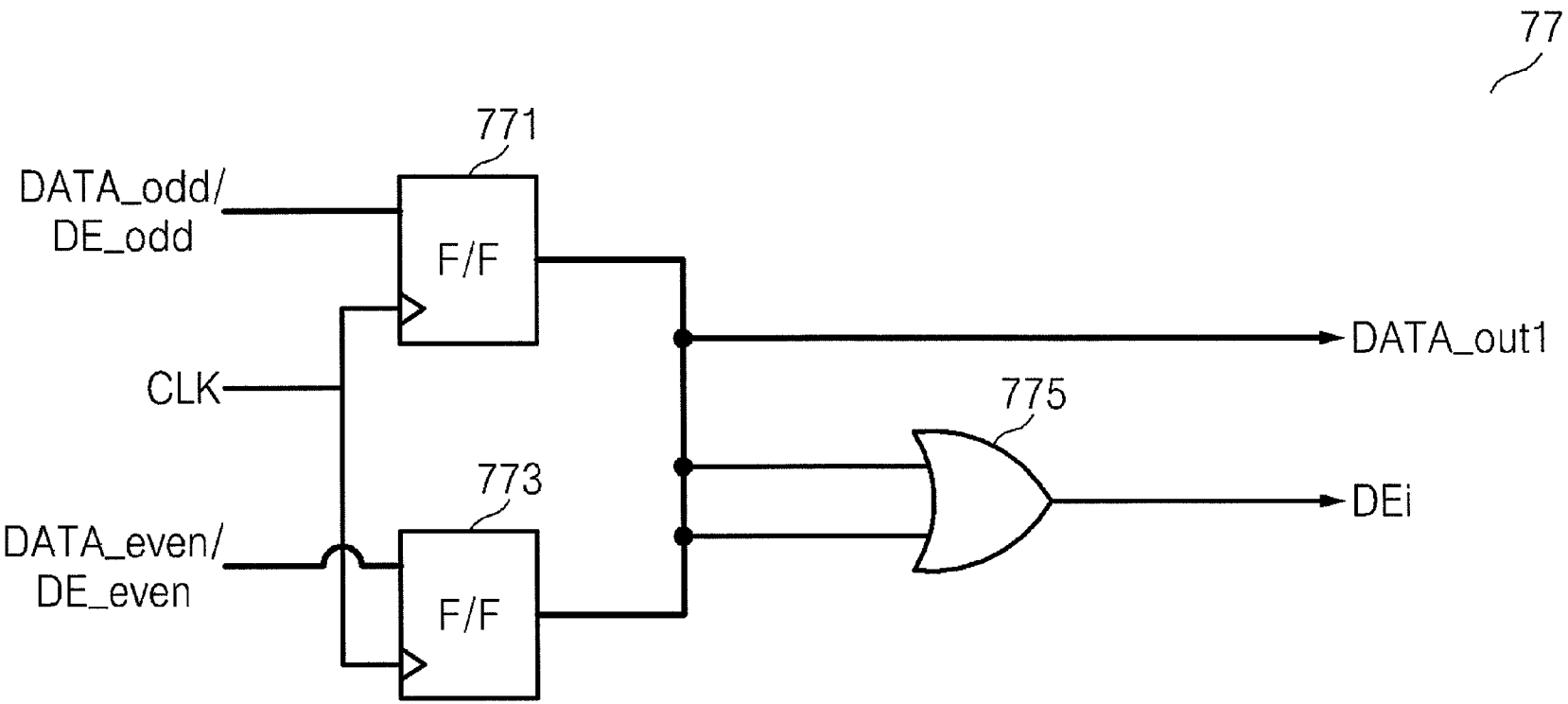
FIGS. 4 and 5 are circuit diagrams of the first and second stages of FIG. 2 according to exemplary embodiments of the inventive concept.

FIG. 4 is a circuit diagram of the first stage 77 of FIG. 2, according to an exemplary embodiment of the inventive concept. Referring to FIGS. 1-4, the first stage 77 may latch each of the third data enable signal DE_odd and the fourth data enable signal DE_even based on the first clock signal CLK. The first stage 77 may perform a logic operation on the third data enable signal DE_odd and the fourth data enable signal DE_even, which are latched therein, and output a logic operation result DEi as a data enable signal.

The first stage 77 may also latch each of the third image data DATA_odd and the fourth image data DATA_even based on the first clock signal CLK, and output image data DATA_out 1 of the N-th horizontal line based on the third image data DATA_odd and the fourth image data DATA_even.

For example, the first stage 77 may latch the third image data DATA_odd and the fourth image data DATA_even, which respectively occupy the even position and the odd position on the N-th horizontal line, allocating the third image data DATA_odd and the fourth image data DATA_even to the N-th horizontal line, and output an allocation result as the image data DATA_out1 of the N-th horizontal line.

The first stage 77 may include a first latch 771 (e.g., a flip-flop), a second latch 773 (e.g., a flip-flop), and a logic operation unit 775. The first latch 771 may latch the third image data DATA_odd or the third data enable signal DE_odd based on the first clock signal CLK. The second latch 773 may latch the fourth image data DATA_even or the fourth data enable signal DE_even based on the first clock signal CLK.

The logic operation unit 775 may perform a logic operation on output signals of the first and second latches 771 and 773, and output the logic operation result DEi as a data enable signal. The logic operation unit 775 may perform an OR or AND operation on the output signals of the first and second latches 771 and 773.

Referring back to FIG. 2, the second stage 79 may remove the first surge signal SS1 of FIG. 3, which may be generated during a first logic level (e.g., a high level "1") period of the data enable signal DEi output from the first stage 77. Alternately, although not shown in FIG. 3, the first surge SS1 may be generated during a second logic level (e.g., a low level "0") or during a transition between levels (e.g., from low to high or vice versa) of a period of the data enable signal Dei.

Figure 5:
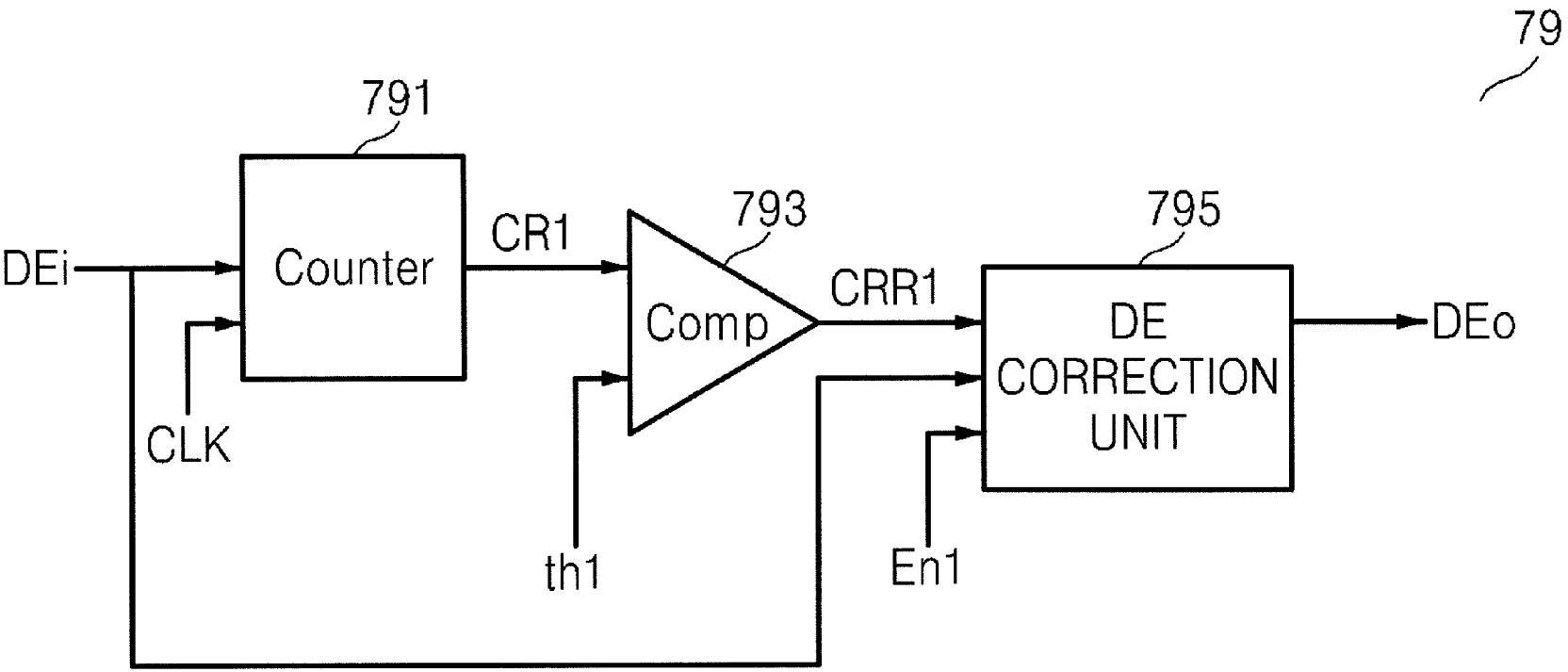

FIG. 5 is a circuit diagram of the second stage 79 of FIG. 2, according to an exemplary embodiment of the inventive concept. Referring to FIGS. 1-5, the second stage 79 may include a counter 791, a comparator 793, and a data enable signal correction unit 795.

The counter 791 may count the number of cycles of an oscillating clock signal (e.g., the first clock signal CLK) during a second logic level (e.g., a low level "0") period of the first surge signal SS1 of FIG. 3, for example, and output a count result CR1. The first surge signal SS1 may be set to a second logic level (e.g., a low level "0") during the first logic level (e.g., a high level "1") period of the data enable signal DEi.

The comparator 793 may compare the output result CR1 of the counter 791 and a reference value th1, and output a comparison result CRR1 having the first logic level (e.g., a high level "1") when the output result CR1 of the counter 791 is greater than the reference value th1. When the output result CR1 of the counter 791 is smaller than the reference value th1, the comparator 793 may output a comparison result CRR1 having the second logic level (e.g., a low level "0"). For example, the comparison result CRR1 may indicate whether the width of the SS1 first surge has exceeded a predefined threshold width. In this way, the criteria width for what is considered a first surge SS1 may be tuned.

The data enable signal correction unit 795 may output the data enable signal DEi without change (DEo), or remove the first surge signal SS1 generated at the second logic level (e.g., a low level "0") during the first logic level (e.g., a high level "1") period of the data enable signal DEi and output a signal removed of the first surge signal SS1 as the data enable signal (DEo), based on a result of the comparison of the comparator 793. For example, the data enable signal correction unit 795 may output the data enable signal DEi without change (DEo), in response to the comparison result CRR1 having the first logic level (e.g., a high level "1").

The data enable signal correction unit 795, in response to the comparison result CRR1 having the second logic level (e.g., a low level "0") may remove the first surge signal SS1 generated at the second logic level (e.g., a low level "0") during the first logic level (e.g., a high level "1") period of the data enable signal DEi, and output a signal in which the first surge signal SS1 is removed from the data enable signal. The width of the surge signal SS1 may be substantially smaller than a cycle of the data enable signal.

The second stage 79 of the display apparatus 10 according to an exemplary embodiment of inventive concept may determine the influence or strength of the first surge signal SS1 by using the counter 791 and the comparator 793. Accordingly, when the surge signal SS1 is lower or shorter than a predetermined reference value, it may be removed. The data enable signal correction unit 795 may operate in response to the enable signal En1.

Figure 6:
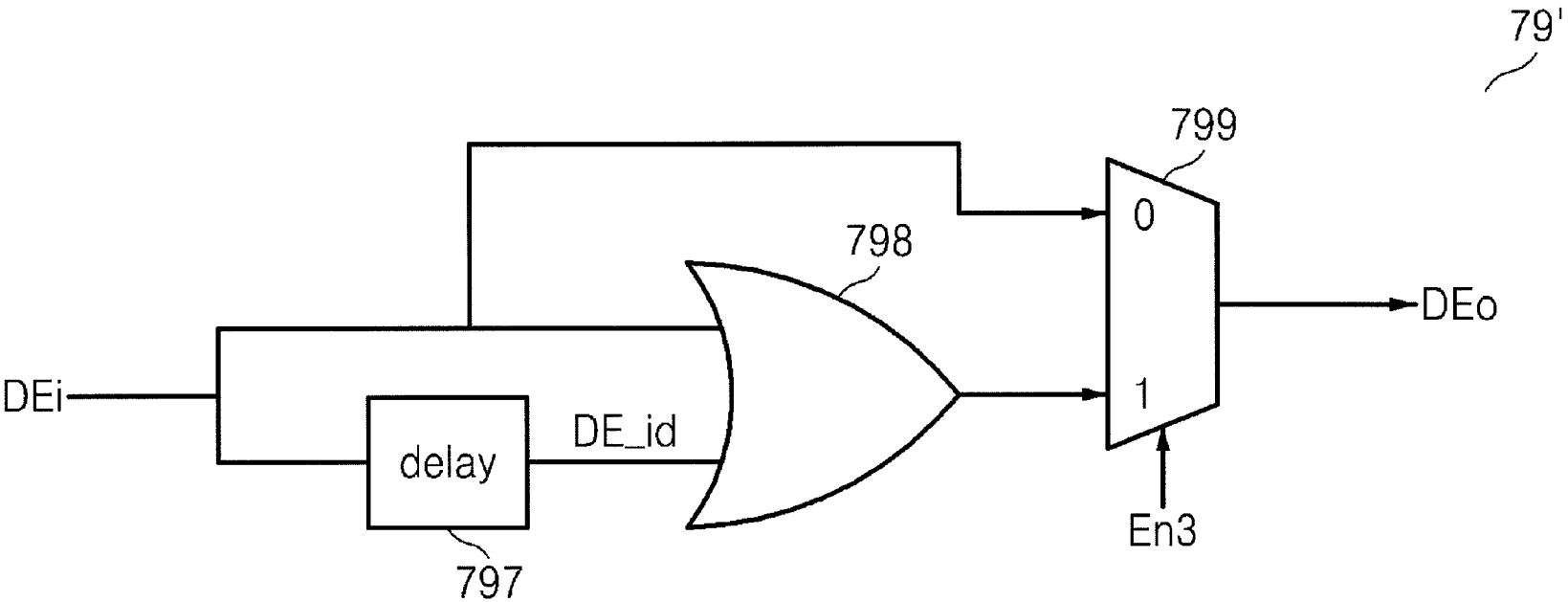
FIG. 6 is a circuit diagram of a second stage according to an exemplary embodiment of the inventive concept.

FIG. 6 is a circuit diagram of a second stage 79' according to an exemplary embodiment of the inventive concept. Referring to FIGS. 1-4 and 6, the second stage 79' may include a delay unit 797, a logic operation unit 798, and a selector 799 (e.g., a multiplexer).

The delay unit 797 may receive the data enable signal DEi, delay the received data enable signal DEi for a predetermined period of time, and output a delayed data enable signal DE_id. The logic operation unit 798 may perform a logic operation on the data enable signal DEi and the delayed data enable signal DE_id, and output a result of the logic operation. The logic operation unit 798 may perform an OR operation on the data enable signal DEi and the delayed data enable signal DE_id. For example, due to the OR operation of the logic operation unit 798, the first surge signal SS1 generated in the second logic level (e.g., a low level "0") during the first logic level (e.g., a high level "1") of the data enable signal DEi may be removed, or neglected.

The selector 799, in response to a control signal En3, may output the data enable signal DEi or the operation result of the logic operation unit 798, as a data enable signal DEo removed of the surge signal SS1.

Referring back to FIGS. 1 and 2, the third stage 81 may receive the data enable signal DEo generated by the second stage 79, and remove a second surge signal SS2 of FIG. 3, which is generated during the second logic level (e.g., a low level "0") period of the received data enable signal DEo.

Figure 8:
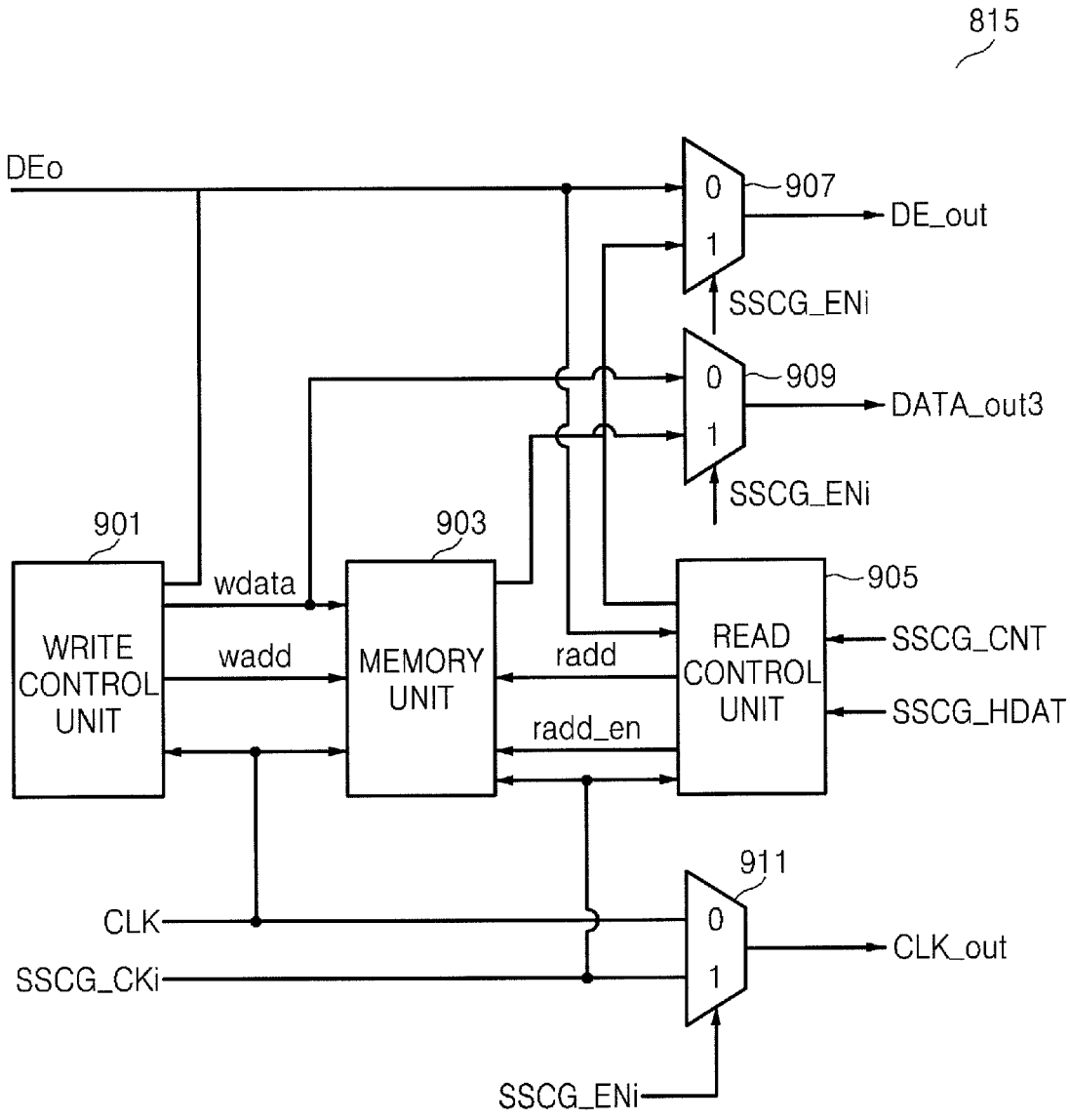
FIG. 8 is a circuit diagram of the read/write controller of FIG. 7 according to an exemplary embodiment of the inventive concept.

The third stage 81 may have parallel input parallel output (PIPO) and may write the image data DATA_out1 to a memory unit 903 of FIG. 8, for example, or output the image data stored in the memory unit 903, in response to the first clock signal CLK or a second clock signal SSCG_CK.

Figure 7:
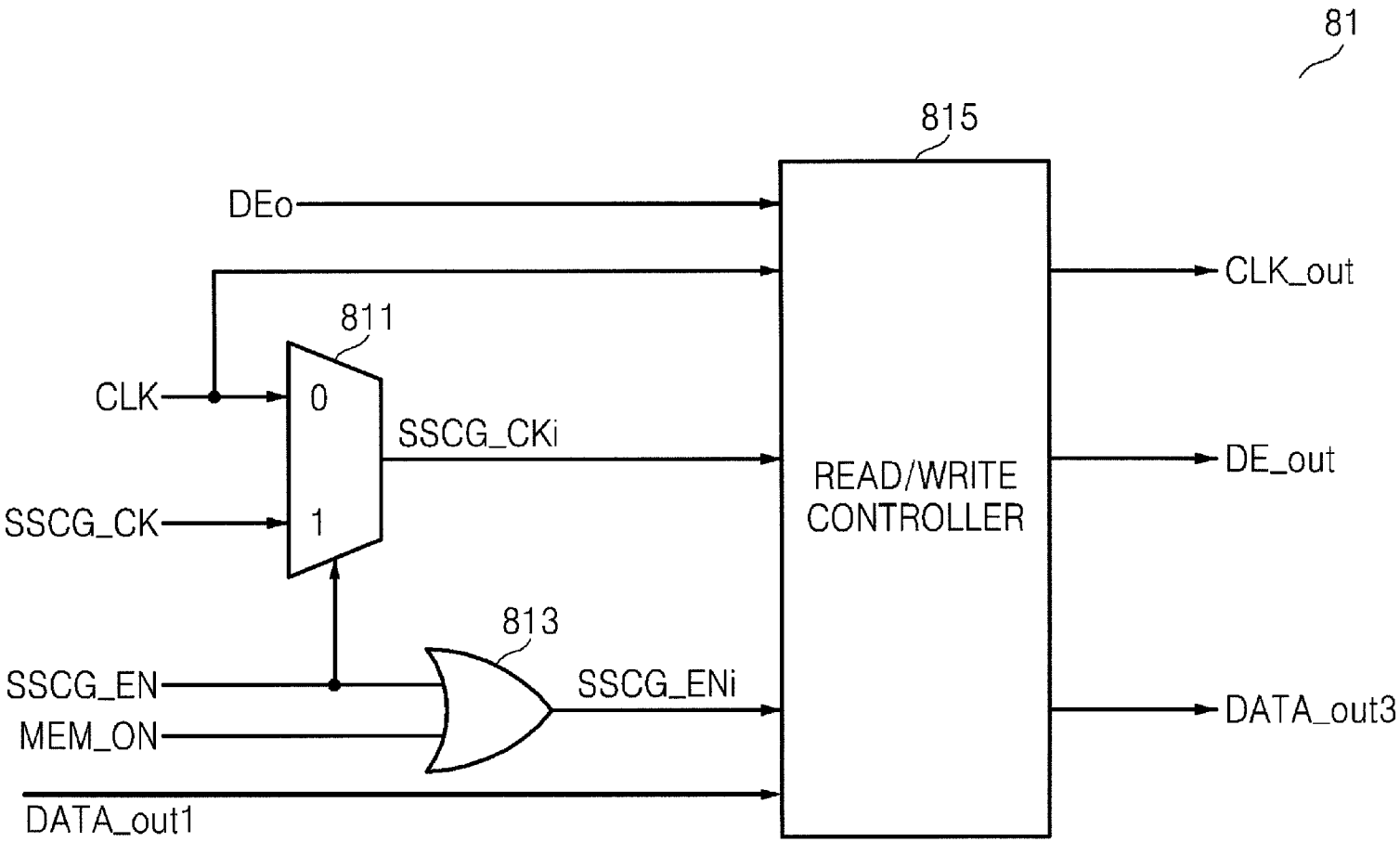
FIG. 7 is a circuit diagram of the third stage of FIG. 2 according to an exemplary embodiment of the inventive concept.

FIG. 7 is a circuit diagram of the third stage 81 of FIG. 2, according to an exemplary embodiment of the inventive concept. FIG. 8 is a circuit diagram of a read/write controller of FIG. 7 according to an exemplary embodiment of the inventive concept. Referring to FIGS. 1, 2, and 7-8, the third stage 81 will be described in more detail below.

The third stage 81 may include a selector 811 (e.g., a multiplexer), a logic operation unit 813, and a read/write controller 815. The selector 811, in response to a first control signal SSCG_EN, may output any one of the first clock signal CLK and the second clock signal SSCG_CK. The first clock signal CLK may be generated by the LVDS signal receiving unit 71 and the second clock signal SSCG_CK may generated by a clock generator 83 of FIG. 2 that is separately provided. The clock generator 83 may be a phase lock loop (PLL) or a delayed lock loop (DLL).

The logic operation unit 813 may perform a logic operation on the first control signal SSCG_EN and a second control signal MEM_ON, and output a logic operation result SSCG_ENi.

Figure 12:
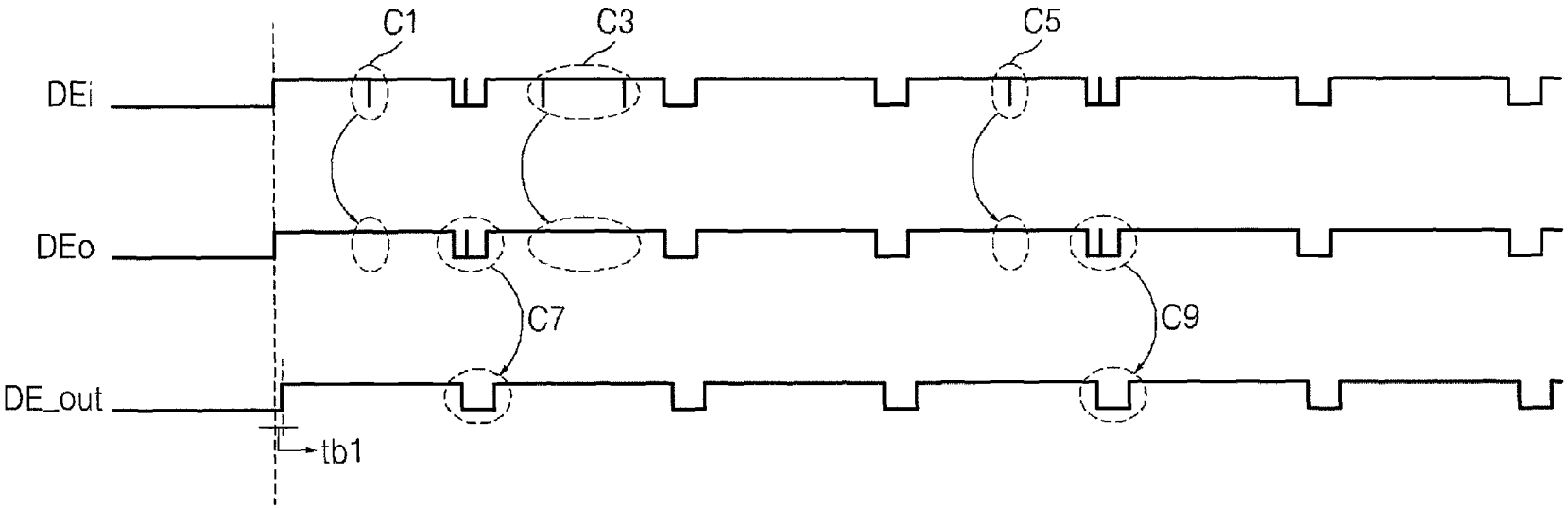
FIGS. 12 and 13 are exemplary waveform diagrams of output signals to explain a process of removing a surge signal using the timing controller of FIG. 2 according to an exemplary embodiment of the inventive concept.

The read/write controller 815 may buffer the image data DATA_out 1 for a predetermined period of time tb1 of FIG. 12, for example, and output a buffered image data DATA_out3. For example, the read/write controller 815 may write the image data DATA_out1 to the memory unit 903 based on the first clock signal CLK, and read the image data stored in the memory unit 903 based on an output signal SSCG_CKi of the selector 811.

The read/write controller 815 may also receive the data enable signal DEo generated by the second stage 79 or 79', remove the second surge signal SS2 of FIG. 3, for example, generated during the second logic level (e.g., a low level "0") period of the received data enable signal DEo, and output a data enable signal DE_out removed of the second surge signal SS2.

The read/write controller 815 may output a signal that transitions from the second logic level (e.g., a low level "0") to the first logic level (e.g., a high level "1") as the data enable signal DE_out, when the first logic level (e.g., a high level "1") of the data enable signal DEo is maintained to be longer than or equal to the first reference value SSCG_CNT.

The read/write controller 815 may output a signal that transitions from the first logic level (e.g., a high level "1") to the second logic level (e.g., a low level "0") as the data enable signal DE_out, when a state after a logic level transition is maintained to be as long as a second reference value SSCG_HDAT.

The read/write controller 815 may include a write control unit 901, the memory unit 903, a read control unit 905, a first selector 907 (e.g., a multiplexer), a second selector 909 (e.g., a multiplexer), and a third selector 911 (e.g., a multiplexer). The write control unit 901 may write the image data DATA_out1 to the memory unit 903 based on the first clock signal CLK. The write control unit 901 may generate a particular address wadd of the memory unit 903 and data wdata (e.g., including image data DATA_out1) to be written to the particular address wadd.

The memory unit 903 may store the image data DATA_out1 written by the write control unit 901. The read control unit 905 may output the image data previously stored in the memory unit 903, in response to the clock signal SSCG_CKi output from the selector 811 of FIG. 7. The read control unit 905 may output a particular address radd of the memory unit 903 and a signal radd_en to instruct a read of the image data.

The read control unit 905 may receive the data enable signal DEo, remove the surge signal SS2 of FIG. 3, for example, included in the received data enable signal DEo, and output the data enable signal DE_out excluding the surge signal. For example, the read control unit 905 may receive the data enable signal DEo, and output a signal that transitions from the second logic level (e.g., a low level "0") to the first logic level (e.g., a high level "1") as the data enable signal DE_out, when the first logic level (e.g., a high level "1") of the data enable signal DEo is maintained to be longer than or equal to the first reference value SSCG_CNT.

The read control unit 905 may output a signal that transitions from the first logic level (e.g., a high level "1") to the second logic level (e.g., a low level "0") as the data enable signal DE_out, when a state after a logic level transition is maintained to be as long as a second reference value SSCG_HDAT.

Figure 9:
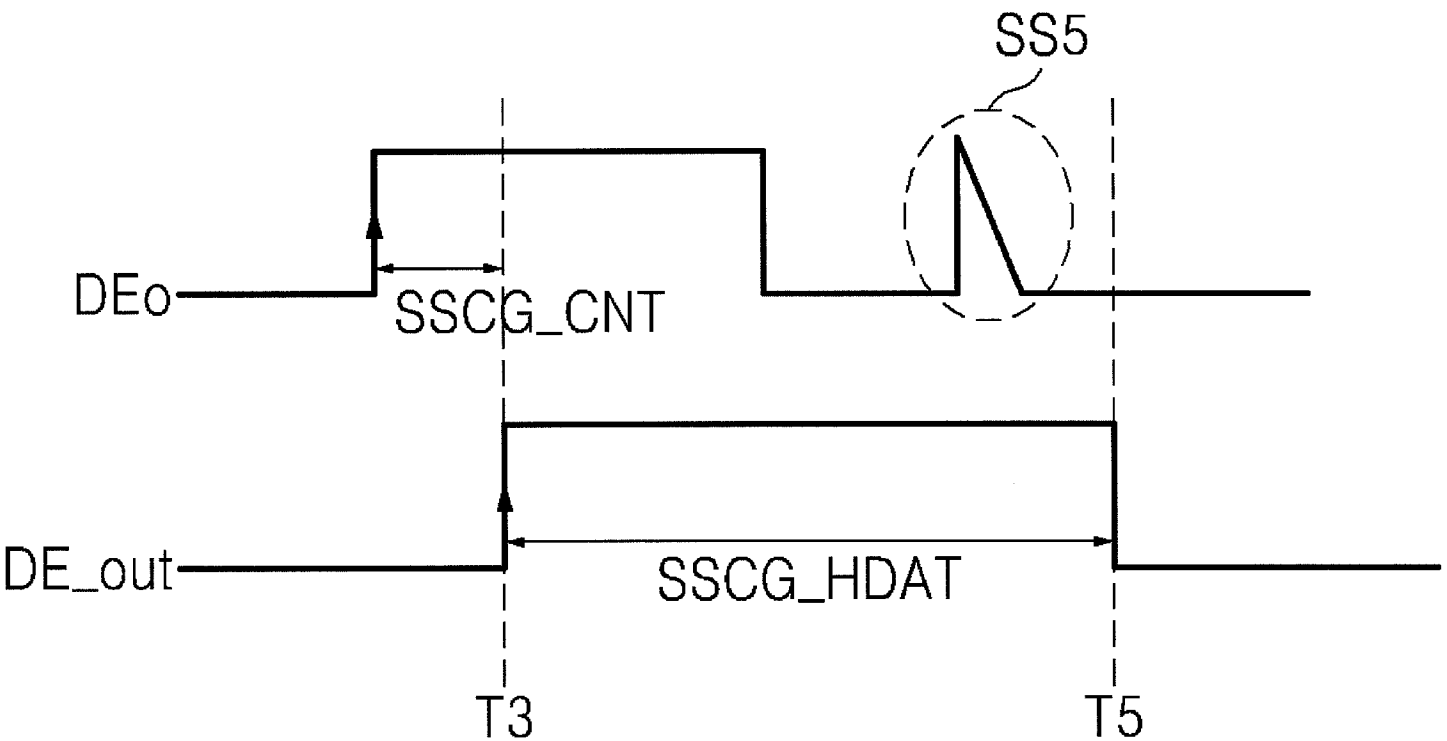
FIG. 9 illustrates exemplary output characteristic of a data enable signal generated in the third stage of FIG. 2.

FIG. 9 illustrates an exemplary output characteristic of the data enable signal DE_out generated in the third stage 81 of FIG. 2. Referring to FIGS. 8 and 9, the read control unit 905 may generate the data enable signal DE_out having a first edge, for example, a rising edge, at a first time point T3 when the first logic level (e.g., a high level "1") of the data enable signal DEo is maintained to be longer than or equal to the first reference value SSCG_CNT.

The read control unit 905 may generate the data enable signal DE_out having the first logic level (e.g., a high level "1") during the second reference value SSCG_HDAT, for example, and until a second edge, for example, a falling edge, at the second time point T5, after the first edge of the first time point T3. The read control unit 905 of the third stage 81 according to an exemplary embodiment of the inventive concept may generate a data enable signal DE_out that excludes or includes the surge signal SS5 included in the data enable signal DEo generated by the second stage 79.

FIG. 10 is a table for explaining an operation of the read/write controller 815 of FIG. 7. Referring to FIGS. 7-10, when both of the first control signal SSCG_EN and the second control signal MEM_ON are set to the second logic level (e.g., a low level "0"), the clock signal SSCG_CKi output from the selector 811 becomes the first clock signal CLK; and the image data DATA_out1 output from the second stage 79 is bypassed and thus output as the output image data DATA_out3 of the third stage 81.

When the first control signal SSCG_EN is set to the second logic level (e.g., a low level "0") and the second control signal MEM_ON is set to the first logic level (e.g., a high level "1"), the clock signal SSCG_CKi output from the selector 811 becomes the first clock signal CLK. The image data DATA_out1 output from the second stage 79 may be buffered by the read/write controller 815 so that the buffered data may be output as the output image data DATA_out3 of the third stage 81.

When the first control signal SSCG_EN is set to the first logic level (e.g., a high level "1") and the second control signal MEM_ON is set to the second logic level (e.g., a low level "0"), the clock signal SSCG_CKi output from the selector 811 becomes the second clock signal SSCG_CK. The image data DATA_out1 output from the second stage 79 may be buffered by the read/write controller 815 so that the buffered data may be output as the output image data DATA_out3 of the third stage 81.

When both the first control signal SSCG_EN and the second control signal MEM_ON are set to the first logic level (e.g., a high level "1"), the clock signal SSCG_CKi output from the selector 811 becomes the second clock signal SSCG_CK. The image data DATA_out1 output from the second stage 79 may be buffered by the read/write controller 815 so that the buffered data may be output as the output image data DATA_out3 of the third stage 81.

Referring back to FIG. 8, the first selector 907 may output the data enable signal DEo generated by the second stage 79 or the data enable signal output from the read control unit 905, as the data enable signal DE_out, based on a selection signal. The selection signal is the output signal SSCG_ENi of the logic operation unit 813. The second selector 909 may output the image data wdata written by the write control unit 901 or the image data stored in the memory unit 903, as the output image data DATA_out3, based on the same selection signal (e.g., SSCG_ENi). The third selector 911 may output the first clock signal CLK or the output signal SSCG_CKi of the selector 811 based on the same selection signal (e.g., SSCG_ENi).

Figure 11:
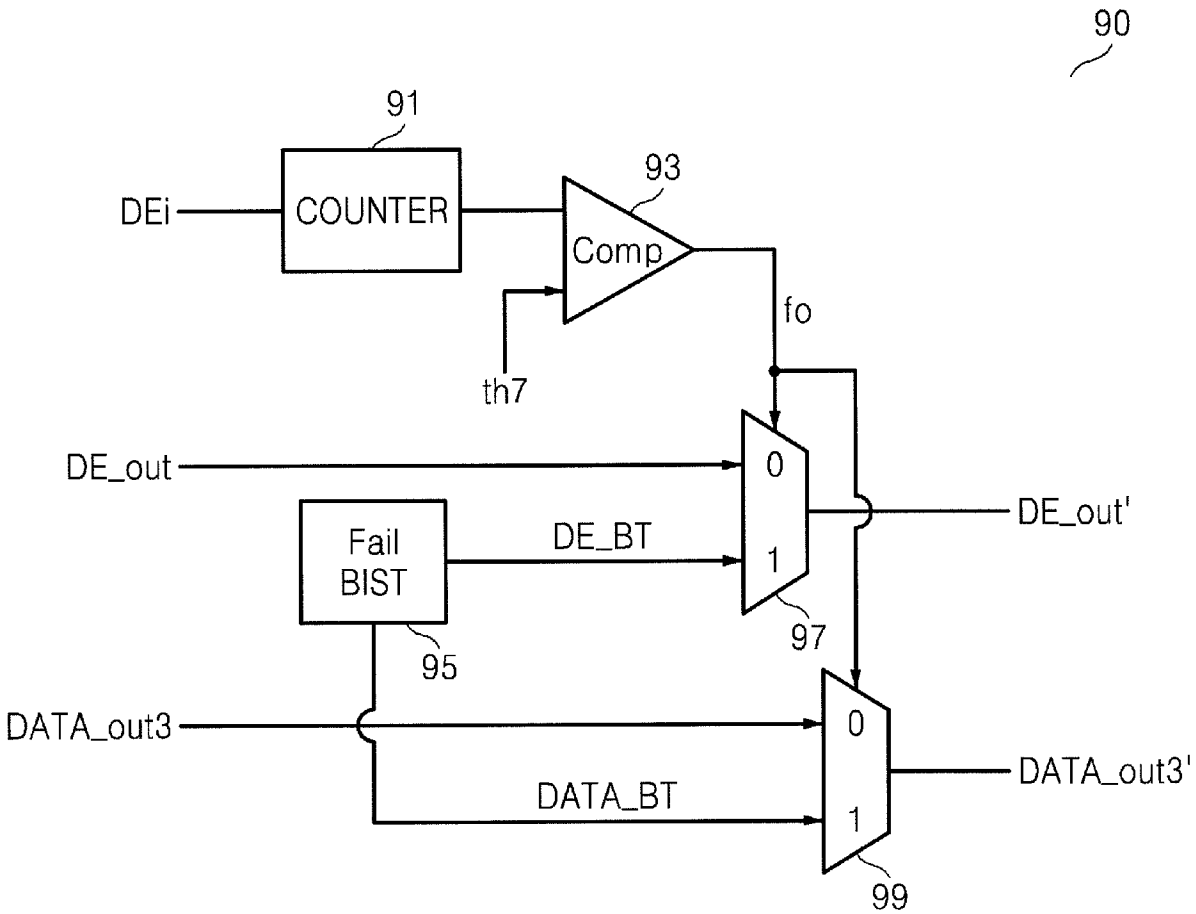
FIG. 11 is a circuit diagram of a fail detector that may be implemented in the timing controller of FIG. 2 according to an exemplary embodiment of the inventive concept.

The timing controller 30 may further include a fail detector 90 of FIG. 11. FIG. 11 is a circuit diagram of the fail detector 90 that may be implemented in the timing controller 30 of FIG. 2 according to an exemplary embodiment of the inventive concept. Referring to FIGS. 2 and 11, the fail detector 90 may detect the failure of the data enable signal DEi based on the number of cycles of a clock signal, for example, the first clock signal CLK, that oscillates during an interval in which the data enable signal DEi input to the second stage 79 is set to the first logic level (e.g., a high level "1").

The failure of the data enable signal DEi may be indicated by a signal indicating whether the data enable signal DEi is distorted by the surge signals SS1 and SS2 of FIG. 3, for example. When a failure is generated in the data enable signal DEi, the fail detector 90 may output a data enable signal DE_BT and image data DATA_BT of a previously stored pattern. For example, the fail detector 90 may detect a failure of the data enable signal DEi when the surge signals SS1 and SS2 of FIG. 3, for example, are generated in the data enable signal DEi and thus a failure state in which the logic level state of the data enable signal DEi is changed, is maintained for a predetermined period of time. The period of time during which the failure state is maintained may be counted by the number of cycles of a clock signal, for example, the first clock signal CLK.

Thus, since the fail detector 90 of the timing controller 30 according to an exemplary embodiment of the inventive concept counts the number of cycles of the surge signals SS1 and SS2 of FIG. 3, for example, and detects the presence of a failure based on a count result, the display apparatus 10 may be prevented from operating in a fail safe mode (FSM) in which the fail detector 90 outputs the data enable signal DE_BT and the image data DATA_BT of a previously stored pattern.

The fail detector 90 may include a counter 91, a comparator 93, a fail built in self test (BIST) block 95, a first selector 97 (e.g., a multiplexer), and a second selector 99 (e.g., a multiplexer). The counter 91 may count the number of cycles of an oscillating clock signal, for example, the first clock signal CLK, during the first logic level (e.g., a high level "1") of the data enable signal DEi, and output a count result.

The comparator 93 may compare the output result of the counter 91 and a reference value th7, and output a comparison result fo. For example, when the output result of the counter 91 is greater than the reference value th7, the comparator 93 may output the comparison result fo having the first logic level (e.g., a high level "1"). Further, when the output result of the counter 91 is smaller than the reference value th7, the comparator 93 may output the comparison result fo having the second logic level (e.g., a low level "0").

The fail BIST block 95 may store the data enable signal DE_BT and the image data DATA_BT of a previously stored pattern. The first selector 97 may output the image data enable signal DE_out of the third stage 81 or the data enable signal DE_BT output from the fail BIST block 95. The second selector 99 may output the image data DATA_out3 of the third stage 81 or the image data DATA_BT output from the fail BIST block 95, based on the comparison result fo of the comparator 93.

Referring back to FIG. 1, the source driver 40 may convert the image data DATA to a predetermined gamma voltage level and a predetermined polarity and output the corresponding converted data to data lines of the display panel 60, based on the image data DATA, the data enable signal DE, and various driving signals, for example, a vertical or horizontal sync signal (not shown), output from the timing controller 30.

The gate driver 50 may sequentially turn on the gate lines of the panel 60 based on the gate driver driving signal GS output from the timing controller 30. The display panel 60 may include a plurality of source lines (not shown; or data lines), a plurality of gate lines (not shown; or scan lines), and a plurality of pixels (not shown).

FIG. 12 is an exemplary waveform diagram of output signals to explain a process of removing a surge signal using the timing controller 30 of FIG. 2 according to an exemplary embodiment of the inventive concept. Referring to FIGS. 2 and 12, when surge signals C1-C9 are included in the data enable signal DEi output from the first stage 77, the second stage 79 may output the data enable signal DEo in which the surge signals C1, C3, and C5 that are generated during the first logic level (e.g., a high level "1" period of the data enable signal DEi, are removed.

The third stage 81 may remove the surge signals C7 and C9 that are generated during the second logic level (e.g., a low level "0") period of the data enable signal DEi, and output the data enable signal DE_out obtained by buffering the data enable signal removed of the surge signals C7 and C9 for a predetermined time tb1.

Figure 13:
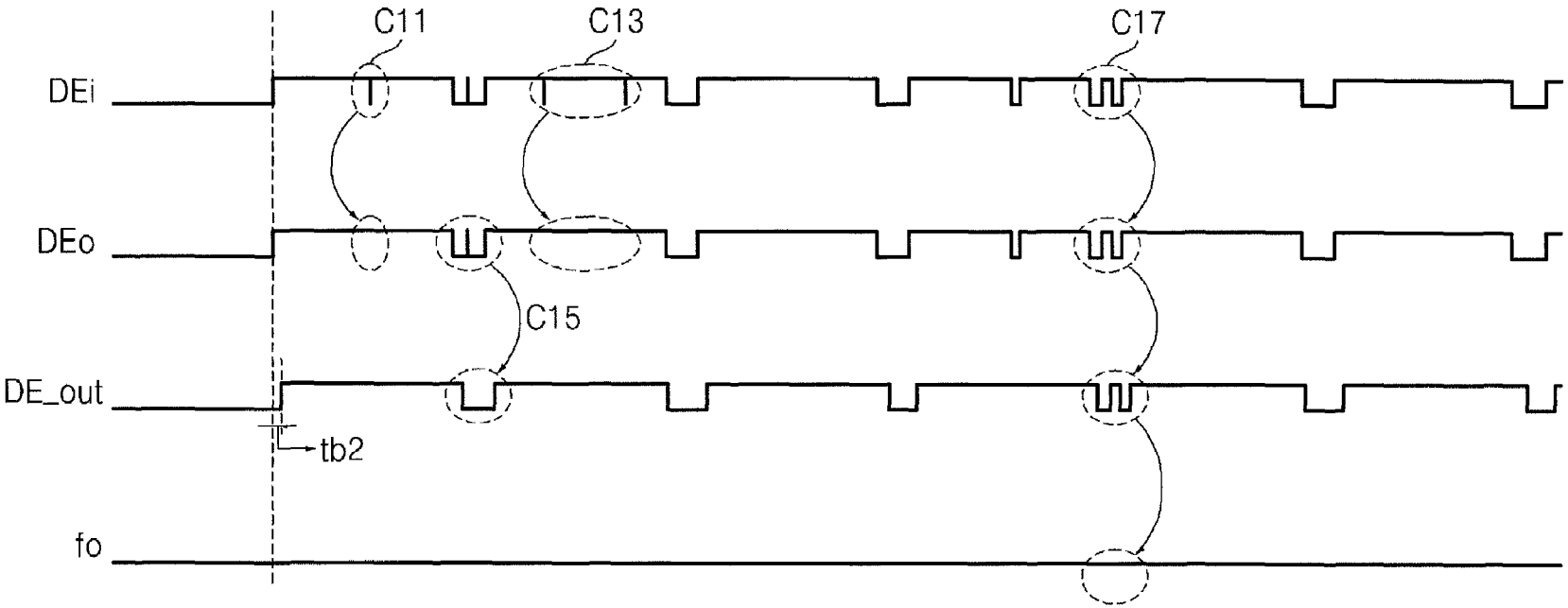

FIG. 13 is an exemplary waveform diagram of output signals to explain the process of removing a surge signal using the timing controller 30 of FIG. 2. Referring to FIGS. 2, 11, and 13, when surge signals C11-C17 are included in the data enable signal DEi output from the first stage 77, the second stage 79 may output the data enable signal DEo in which the surge signals C11 and C13 that are generated during the first logic level (e.g., a high level "1") period of the data enable signal DEi, are removed.

The third stage 81 may remove the surge signal C15 that is generated during the second logic level (e.g., a low level "0") period of the data enable signal DEi, and output the data enable signal DE_out obtained by buffering the data enable signal removed of the surge signal C15 for a predetermined time tb2.

The timing controller 30 may output the comparison result fo of the second logic level (e.g., a low level "0") when the count value of the clock signal with respect to the surge signal C17 is less than the reference value th7, even when the surge signal C17 oscillating for a predetermined period is included in the data enable signal DEi. Thus, the timing controller 30 according to an exemplary embodiment of the inventive concept is less likely to operate in the FSM due to the surge signal C17.

Figure 14:
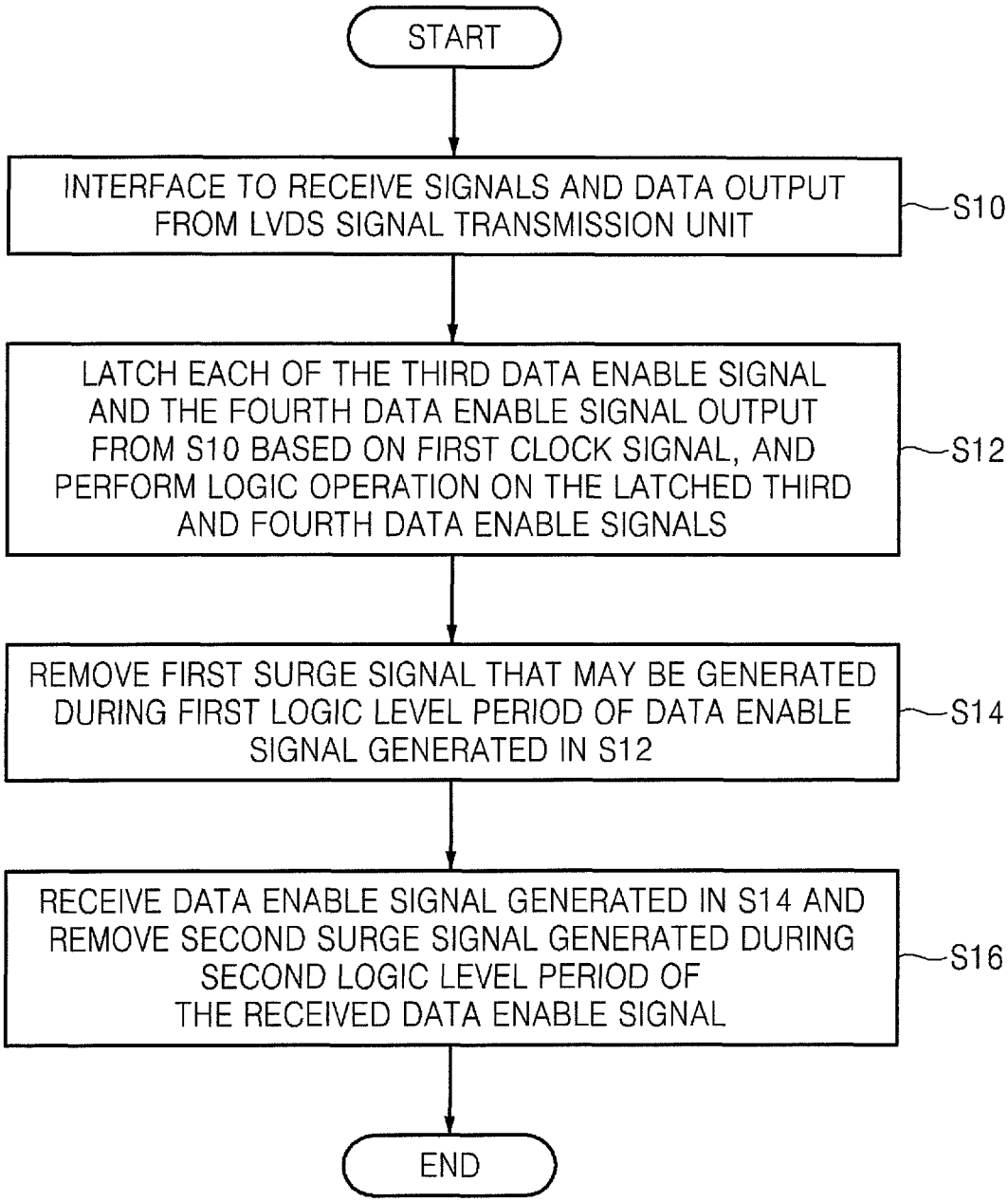
FIG. 14 is a flowchart for explaining a method of removing a surge signal from a data enable signal according to an exemplary embodiment of the inventive concept.

FIG. 14 is a flowchart for explaining a method of removing a surge signal from a data enable signal according to an exemplary embodiment of the inventive concept. Referring to FIGS. 2 and 14, the LVDS signal receiving unit 71 may interface with a first stage (e.g., 77) and the LVDS signal transmission unit 20 to receive the data enable signals and image data, (e.g., the first data enable signal DE_O and the second data enable signal DE_E, and the first image data DATA_O and the second image data DATA_E, which are output from the LVDS signal transmission unit 20 (S10).

The first stage 77 may latch each of the third data enable signal DE_odd and the fourth data enable signal DE_even based on the first clock signal CLK, perform a logic operation on the third data enable signal DE_odd and the fourth data enable signal DE_even, which are latched therein, and output the logic operation result DEi as a data enable signal (S12).

The second stage 79 may remove the first surge signal that may be generated during the first logic level (e.g., a high level "1" period of the data enable signal DEi output from the first stage 77 (S14). The third stage 81 may receive the data enable signal DEo generated by the second stage 79 and remove the second surge signal SS2 of FIG. 3, which is generated during the second logic level (e.g., a low level "0") period of the received data enable signal DEo (S16).

As described above, in a timing controller according to an exemplary embodiment of the inventive concept and the display apparatus including the timing controller, a surge signal that may distort a data enable signal is removed. Further, the display apparatus including the timing controller is less likely to operate in the FSM due to the surge signal.

While the inventive concept has been particularly shown and described with reference to exemplary embodiments thereof, it will be understood that various changes in form and details may be made therein without departing from the spirit and scope of the disclosure.

What is claimed is:

1. A timing controller comprising:

a first stage configured to remove a first surge signal during only a first logic level period of a data enable signal to generate a modified data enable signal; and a second stage configured to receive the modified data enable signal generated by the first stage and remove a second surge signal during only a second logic level period of the modified data enable signal, wherein the first logic level differs from the second logic level, wherein the data enable signal comprises a first data enable signal and a second data enable signal, and the timing controller further comprising a third stage that latches each of the first data enable signal and the second data enable signal based on a clock signal, performs a logic operation on the latched first and second enable signals, and outputs a logic operation result as a data enable signal input to the first stage.

2. The timing controller of claim 1, wherein the first stage comprises:

a counter configured to count the number of cycles of a first clock signal that oscillates during the second logic level period of the first surge signal and output a count result;

a comparator configured to compare an output result of the counter and a reference value and output a comparison result; and a data enable signal correction unit configured to output one of the data enable signal without change, or remove the first surge signal having the second logic level during the first logic level period of the data enable signal and output a signal removed of the first surge signal as the data enable signal, based on the comparison result of the comparator.

3. The timing controller of claim 1, wherein the first stage comprises:

a delay unit configured to receive the data enable signal, delaying a received data enable signal for a predetermined period of time, and output a delayed data enable signal;

a logic operation unit configured to perform a logic operation on the data enable signal and the delayed data enable signal and output a logic operation result; and a selector, in response to a control signal, configured to output one of the data enable signal or the logic operation result as a data enable signal removed of the first surge signal.

4. The timing controller of claim 1, wherein the second stage comprises:

a first selector, in response to a first control signal, configured to output one of a first clock signal and a second clock signal;

a logic operation unit configured to perform a logic operation on the first control signal and a second control signal and output a logic operation result; and a read/write controller configured to store the image data based on the first clock signal and read the image data based on an output signal of the first selector.

5. The timing controller of claim 4, wherein the read/write controller outputs a signal that transitions from the second logic level to the first logic level when the first logic level of the data enable signal is maintained to be longer than or equal to a first reference value, and transitions from the first logic level to the second logic level when the first logic level after logic level transition is maintained to be longer than or equal to a second reference value, as the data enable signal.

6. The timing controller of claim 4, wherein the read/write controller comprises:

a memory unit configured to store the image data;

a write control unit configured to write the image data to the memory unit based on the first clock signal;

a read control unit configured to receive the data enable signal and outputting, as the data enable signal, a signal that transitions from the second logic level to the first logic level when the first logic level of the data enable signal is maintained to be longer than or equal to the first reference value, and transitions from the first logic level to the second logic level when the first logic level after logic level transition is maintained to be longer than or equal to the second reference value; and a second selector configured to output one of the data enable signal generated by the first stage or an output signal of the read control unit, based on a selection signal, wherein the selection signal is the output signal of the logic operation unit.

7. The timing controller of claim 6, further comprising:

a third selector configured to output one of the image data output from the write control unit or the image data stored in the memory unit, as image data of the timing controller, based on the selection signal; and a fourth selector configured to output one of the first clock signal or an output signal of the first selector, as a clock signal of the timing controller, based on the selection signal.

8. The timing controller of claim 1, further comprising a fail detector that detects whether a failure of the data enable signal has occurred based on the number of cycles of a clock signal oscillating during the first logic level of the data enable signal, and configured to output a data enable signal output from the second stage when the failure has not been detected and output a data enable signal of a previously stored pattern when the failure has been detected.

9. A timing controller for driving a source driver and a gate driver of a display apparatus, the timing controller comprising:

a timing controller configured to receive odd image data, even image data, an odd data enable signal, and an even data enable signal, output image data from the odd and even image data, and output a corrected data enable signal, the timing controller comprising:

a first stage configured to latch the odd image data, even image data, odd data enable signal, and even data enable signal in response to a clock signal, perform a logical operation on the latched odd and even data enable signals to generate a first data enable signal, and output the image data from the odd and even image data;

a second stage configured to receive the first data enable signal and the image data from the first stage and remove a first surge signal generated during a first logic level period of the first data enable signal to generate a second data enable signal; and a third stage configured to receive the second data enable signal and the image data from the second stage and remove a second surge signal generated during a second logic level period of the received data enable signal to generate the corrected data enable signal.

10. The timing controller of claim 9, further comprising a low voltage differential signaling (LVDS) signal receiving unit that interfaces with a LVDS signal transmission unit and the first stage, and configured to output the odd image data, even image data, odd data enable signal, even data enable signal, and the clock signal.

11. The timing controller of claim 10, wherein the LVDS signal receiving unit comprises:

a first LVDS signal receiving unit to convert original odd image data from the LVDS signal transmission unit and an original odd data enable signal to predetermined different signal levels to generate the odd image data and the odd data enable signal; and a second LVDS signal receiving unit to convert original even image data from the LVDS signal transmission unit and an original even data enable signal to predetermined different signal levels to generate the even image data and the even data enable signal.

12. The timing controller of claim 10, wherein one of the first LVDS signal receiving unit or the second LVDS signal receiving unit generate the clock signal.

13. The timing controller of claim 9, wherein the first stage comprises:

a first flip-flop configured to latch one of the odd image data and the odd data enable signal in response to the clock signal; and a second flip-flop configured to latch one of the even image data and the even data enable signal in response to the clock signal; and one of an OR or an AND gate to receive a first output of the first flip-flop and a second output of the second flip-flop.

14. The timing controller of claim 9, wherein the second stage comprises:

a counter configured to count the number of cycles of the clock signal that oscillates during the second logic level period of the first surge signal and outputs a count result;

a comparator configured to compare the output result of the counter and a reference value and output a comparison result; and a data enable signal correction unit configured to output one of the first data enable signal without change, or remove the first surge signal having the second logic level during the first logic level period of the first data enable signal and output the second data enable signal removed of the first surge signal, based on the comparison result of the comparator.

15. The timing controller of claim 9, wherein the second stage comprises:

a delay unit configured to receive the first data enable signal, delay the received data enable signal for a predetermined period of time, and output a delayed data enable signal;

one of an OR gate or an AND gate to perform a logic operation on the received data enable signal and the delayed data enable signal and output a logic operation result; and a multiplexer, in response to a control signal, configured to output one of the received data enable signal or the logic operation result as the second data enable signal removed of the first surge signal.

16. The timing controller of claim 9, wherein the third stage comprises:

a multiplexer, in response to a first control signal, configured to output one of the clock signal and a second clock signal;

one of an AND gate or a OR gate configured to perform a logic operation on the first control signal and a second control signal and output a logic operation result; and a read/write controller configured to store the image data based on the clock signal and read the image data based on an output signal of the multiplexer.

17. A display apparatus comprising:

a timing controller configured to receive odd image data, even image data, odd data enable signal, and even data enable signal, output image data from the odd and even image data, output a corrected data enable signal from the odd and even data enable signals, and a gate control signal, the timing controller comprising:

a low voltage differential signaling (LVDS) signal receiving unit configured to output odd image data, even image data, an odd data enable signal indicating an effective period of the odd image data, an even data enable signal indicating an effective period of the even image data, and a clock signal;

a first stage configured to latch the odd image data, even image data, odd data enable signal, and even data enable signal in response to the clock signal, perform a logical operation on the latched odd and even data enable signals to generate a first data enable signal, and output the image data from the odd and even image data;

a second stage configured to receive the first data enable signal and the image data from the first stage and remove a first surge signal generated during a first logic level period of the first data enable signal to generate a second data enable signal; and a third stage configured to receive the second data enable signal and the image data from the second stage and remove a second surge signal generated during a second and different logic level period of the received data enable signal to generate the corrected data enable signal;

a display panel including data and gate lines;

a source driver configured to receive the image data and the corrected data enable signal from the timing controller and drive the data lines of the display panel; and a gate driver configured to receive the gate control signal from the timing controller and drive the gate lines of the display panel.

18. The display apparatus of claim 17, wherein the second stage comprises:

a counter configured to count the number of cycles of the clock signal that oscillates during the second logic level period of the first surge signal and output a count result;

a comparator configured to compare the output result of the counter and a reference value and output a comparison result; and a data enable signal correction unit configured to output one of the first data enable signal without change, or remove the first surge signal having the second logic level during the first logic level period of the first data enable signal and output the second data enable signal removed of the first surge signal, based on the comparison result of the comparator.

19. The display apparatus of claim 17, wherein the second stage comprises:

a delay unit configured to receive the first data enable signal, delay the received data enable signal for a predetermined period of time, and output a delayed data enable signal;

a logic operation unit configured to perform a logic operation on the received data enable signal and the delayed data enable signal and output a logic operation result; and a multiplexer, in response to a control signal, configured to output one of the received data enable signal or the logic operation result as the second data enable signal removed of the first surge signal.

* * * * *